US005085252A

United States Patent [19]

Mohamed et al.

[11] Patent Number: 5,085,252

[45] Date of Patent: Feb. 4, 1992

[54] METHOD OF FORMING VARIABLE CROSS-SECTIONAL SHAPED THREE-DIMENSIONAL FABRICS

[75] Inventors: Mansour H. Mohamed, Raleigh, N.C.; Zhong-Huai Zhang, Shanghai, China

[73] Assignee: North Carolina State University, Raleigh, N.C.

[21] Appl. No.: 574,693

[22] Filed: Aug. 29, 1990

[51] Int. Cl.[5] ..... D03D 41/00; D03D 47/04; D03D 13/00

[52] U.S. Cl. ..... 139/22; 139/11; 139/DIG. 1

[58] Field of Search ..... 139/22, 11, 457, DIG. 1, 139/408, 411

[56] References Cited

U.S. PATENT DOCUMENTS

| | | | |
|---|---|---|---|
| 3,834,424 | 9/1974 | Fukuta et al. . | |
| 3,884,429 | 5/1975 | Dow | 139/DIG. 1 |
| 3,993,817 | 11/1976 | Schultz . | |
| 4,001,478 | 1/1977 | King . | |
| 4,031,922 | 6/1977 | Trost et al. | 139/11 |
| 4,066,104 | 1/1978 | Halton et al. | 139/DIG. 1 |
| 4,526,026 | 7/1985 | Knauland, Jr. | 139/22 |
| 4,615,256 | 10/1986 | Fukuta et al. . | |
| 4,712,588 | 12/1987 | Saimen | 139/309 |

OTHER PUBLICATIONS

M. Mohamed and Z. Zhang, "Weaving of 3-D Preforms", Fibertex Conference, Greenville, S.C., (Sep. 13-15, 1988).

M. Mohamed, Z. Zhang, "Manufacture of Multi-Layer Woven Preforms", The American Society of Mechanical Engineers, 81-99 (Nov.-Dec., 1988).

M. Mohamed, Z. Zhang and L. Dickinson, "3-D Weaving of Net Shapes", The Japaneses International Sampe Symposium, 1487-1494 (Nov. 28-Dec. 1, 1989).

*Primary Examiner*—Andrew M. Falik

*Attorney, Agent, or Firm*—Richard E. Jenkins

[57] ABSTRACT

Method of weaving a variable cross-sectional shaped three-dimensional fabric which utilizes different weft yarn insertion from at least one side of the warp layers for selectively inserting weft yarns into different portions of the fabric cross-sectional profile defined by the warp yarn layers during the weaving process. If inserted from both sides of the warp yarn layers, the weft yarns may be inserted simultaneously or alternately from each side of the warp yarn layers. The vertical yarn is then inserted into the fabric by reciprocation of a plurality of harnesses which separate the vertical yarn into a plurality of vertical yarn systems as required by the shape of the three-dimensional fabric being formed.

14 Claims, 10 Drawing Sheets

1 --- FILLING LOCK AND SELVAGE LOCK;

2 --- FILLING INSERTION;

3 --- SELVAGE NEEDLES;

4 --- SELVAGE HOLD ROD;

5 --- BEAT UP;

6 --- FILLING TENSION I;

7 --- FILLING TENSION II;

8 --- LOOP FORMING RODS;

9 --- SELVAGE LATCH NEEDLES;

10 --- SELVAGE TENSION;

11 --- HARNESS 1 & 2;

12 --- HARNESS 3 & 4;

13 --- TAKE UP

FIG. 2

METHOD OF FORMING VARIABLE CROSS-SECTIONAL SHAPED THREE-DIMENSIONAL FABRICS

GOVERNMENT INTEREST

This invention was made with Government support under Grant No. NAGW-1331 awarded by the National Aeronautics and Space Administration (NASA). The Government has certain rights in this invention.

TECHNICAL FIELD

The present invention relates to three-dimensional woven fabric formed of warp, weft and vertical yarns, and more particularly to a method for forming three-dimensional woven fabrics of different cross sections and the fabric produced thereby.

BACKGROUND ART

The use of high-performance composite fiber materials is becoming increasingly common in applications such as aerospace and aircraft structural components. As is known to those familiar with the art, fiber reinforced composites consist of a reinforcing fiber such as carbon or KEVLAR and a surrounding matrix of epoxy, PEEK or the like. Most of the composite materials are formed by laminating several layers of textile fabric, by filament winding, or by cross-laying of tapes of continuous filament fibers. However, all of the structures tend to suffer from a tendency toward delamination. Thus, efforts have been made to develop three-dimensional braided, woven and knitted preforms as a solution to the delamination problems inherent in laminated composite structures.

For example, U.S. Pat. No. 3,834,424 to Fukuta et al. discloses a three-dimensional woven fabric as well as method and apparatus for manufacture thereof. The Fukuta et al. fabric is constructed by inserting a number of double filling yarns between the layers of warp yarns and then inserting vertical yarns between the rows of warp yarns perpendicularly to the filling and warp yarn directions. The resulting construction is packed together using a reed and is similar to traditional weaving with the distinction being that "filling" yarns are added in both the filling and vertical directions. Fukuta et al. essentially discloses a three-dimensional orthogonal woven fabric wherein all three yarn systems are mutually perpendicular, but it does not disclose or describe any three-dimensional woven fabric having a configuration other than a rectangular cross-sectional shape. This is a severe limitation of Fukuta et al. since the ability to form a three-dimensional orthogonal weave with differently shaped cross sections (such as ⊥, ‖, ⊥, and ‖) is very important to the formation of preforms for fibrous composite materials. Applicants have overcome this shortcoming of Fukuta et al. by providing a three-dimensional weaving method which provides for differential weft insertion from both sides of the fabric formation zone so as to allow for an unexpectedly and surprisingly superior capability of producing three-dimensional fabric constructions of substantially any desired cross-sectional configuration.

Also of interest, Fukuta et al. U.S. Pat. No. 4,615,256 discloses a method of forming three-dimensionally latticed flexible structures by rotating carriers around one component yarn with the remaining two component yarns held on bobbins supported in the arms of the carriers and successively transferring the bobbins or yarn ends to the arms of subsequent carriers. In this fashion, the two component yarns transferred by the carrier arms are suitably displaced and zig-zagged relative to the remaining component yarn so as to facilitate the selection of weaving patterns to form the fabric in the shape of cubes, hollow angular columns, and cylinders.

Another type of orthogonally woven reinforcing structure is disclosed by U.S. Pat. No. 3,993,817 to Schultz et al. The apparatus disclosed by Schultz et al. fabricates a woven structure from axial, radial, and circumferential sets of threads. The radial threads are drawn from bobbins and passed through aligned thread guides in successive disks which are arranged about a common central axis and slightly spaced from each other axially. A circumferential thread is drawn from a bobbin and passed in a loop between each of two disks outside of the radial threads, and several turns of it are thus wrapped and the loop tightened to draw the radial threads inwardly. When the desired number of circumferential threads in a given layer have been wrapped between each pair of disks, axial threads are then threaded between adjacent radial threads by leading them through with a knitting needle, and further wraps of circumferential threads may be applied. In this particular orthogonal structure, the axial threads are straight and axially extending while the radial threads lie partly normal to and partly parallel to the axial threads. The circumferential threads are wrapped normal to the axial threads and in an interlaced relationship between and around the radial threads and upon and beneath the axial threads.

Other known methods for forming three-dimensional structures include the AUTOWEAVE BR900 and BR2000 systems developed by Brochier in France and installed at Avco Specialty Materials/Textron facility in Lowell, Mass. The computerized process entails inserting radial rods into a foam mandrel machined to conform to the inside shape of the final product and forming helical tapered corridors therein. Axial yarns are fed into the axial corridors by a shuttle and circumferential yarns are wound into the circumferential corridors to anchor the previously positioned axial yarns so that the alternating axial yarn and circumferential yarn placement produces layers which are used to build up the preformed wall thickness. U.S. Pat. No. 4,001,478 to King discloses yet another method to form a three-dimensional structure wherein the structure has a rectangular cross-sectional configuration as well as a method of producing cylindrical three-dimensional shapes.

DISCLOSURE OF THE INVENTION

In accordance with the present invention, applicants provide a three-dimensional weaving method for production of orthogonal fabrics having a variety of predetermined and variable cross-sectional shapes. A desired predetermined cross section three-dimensional fabric is formed by repeating a cycle of operation which comprises the steps of: providing a plurality of layers of warp yarns which are in horizontal and vertical alignment and maintained under tension, said layers of warp yarns defining a variable predetermined cross-sectional shape; selectively inserting a plurality of weft yarns which are connected by a loop at the respective fore ends thereof into spaces between said layers of warp yarn, said weft yarns being inserted a predetermined and non-uniform horizontal distance from at least one side of said warp yarn cross-sectional shape in accordance with the shape of the fabric being formed; threading binder or selvage yarn through the loops at the fore ends of said weft yarns; bringing a reed into contact with the fell of the fabric being formed; and inserting vertical yarns into spaces between vertically aligned rows of warp yarns in a direction substantially perpendicular to both said warp and weft yarns, said vertical yarns being selectively threaded through a plurality of harnesses so as to be separated into a predetermined plurality of vertically movable yarn systems by said harnesses in accordance with the shape of the fabric being formed, and said yarn systems being selectively vertically moved by said harnesses to insert said vertical yarns into said fabric being formed.

It is therefore the object of this invention to provide a method of weaving a variable cross section three-dimensional fabric in accordance with a desired predetermined cross-sectional shape.

It is another object of the present invention to provide a method for weaving a three-dimensional woven fabric which is not limited to a rectangular cross-sectional shape.

It is another object of the present invention to provide a method for weaving a three-dimensional woven fabric with improved vertical yarn insertion.

It is another object of the present invention to provide a method for weaving three-dimensional woven fabrics from carbon fibers with pneumatic actuators in lieu of electric motors so as to prevent electrical shorting-out problems associated with electric motors in proximity to carbon fibers being constructed into a fabric.

It is yet another object of the present invention to provide a method for differential length weft yarn by inserting weft yarns from either or both sides of the fabric formation zone during three-dimensional weaving so as to form a three-dimensional woven fabric having a predetermined and variable complex cross-sectional shape.

Some of the objects of the invention having been stated, other objects will become evident as the description proceeds, when taken in connection with the accompanying drawings described hereinbelow.

BRIEF DESCRIPTION OF THE DRAWINGS

FIG. 2 is a key to the numbered steps shown in the timing diagram of FIG. 1;

BEST MODE FOR CARRYING OUT THE INVENTION

Three-dimensional woven fabrics are presently formed by arranging warp yarns in multiple layers defining sheds therebetween. A plurality of needles containing doubled filling or weft yarns are simultaneously inserted a uniform distance into the warp sheds from one side thereof. The filling yarns are held on the opposite side of the warp sheds by a catch yarn which passes through the loops of the doubled weft or filling yarns and thus forms the fabric selvage. The weft needles are then returned to their original position at one side of the warp yarn sheds after inserting the doubled filling yarns, and a reed is urged forwardly to beat-up and pack the yarns into a tight structure at the fell of the fabric. Next, a layer of vertical yarns is inserted into the fell of the three-dimensional fabric, and the reed is returned to its original remote position so that the entire weaving cycle may be repeated. Unfortunately, this type of three-dimensional fabric formation does not allow for the formation of integrally woven fabric constructions with variable cross-sectional shapes.

Applicants have overcome the limitations of the prior art in forming integral variable cross-sectionally-shaped three-dimensional fabrics through the method of the present invention which provides for insertion of a plurality of different length weft yarns from one or both sides of the warp yarn sheds. This weft insertion feature when combined with applicants' provision of warp yarn layers in horizontal and vertical alignment so as to define the predetermined desired cross-sectional shape of the fabric provides for unique flexibility in forming multiple and complex cross-sectional shapes for three-dimensional woven fabrics. Moreover, applicants' use of harnesses in order to insert the vertical yarn into the fabric provides for a tight insertion of vertical yarn whether extending for a long or short vertical portion of the cross-sectional shape of the fabric.

Applicants contemplate that all mechanical motions of the process other than fabric take-up should most suitably be pneumatically actuated so as to minimize problems associated with weaving carbon fibers in the presence of conventional electric motors. The take-up motion in the instant process may most suitably be accomplished by an electrical stepper motor and worm gear which positions the electric motor at a safe remote position from the fabric weaving process. Given the general description of the applicants' invention set forth above and with reference now to FIGS. 1–10 of the drawings, applicants now will describe the specific details of the invention which will be clearly understandable to one skilled in the art of three-dimensional fabric formation.

Figure 1:
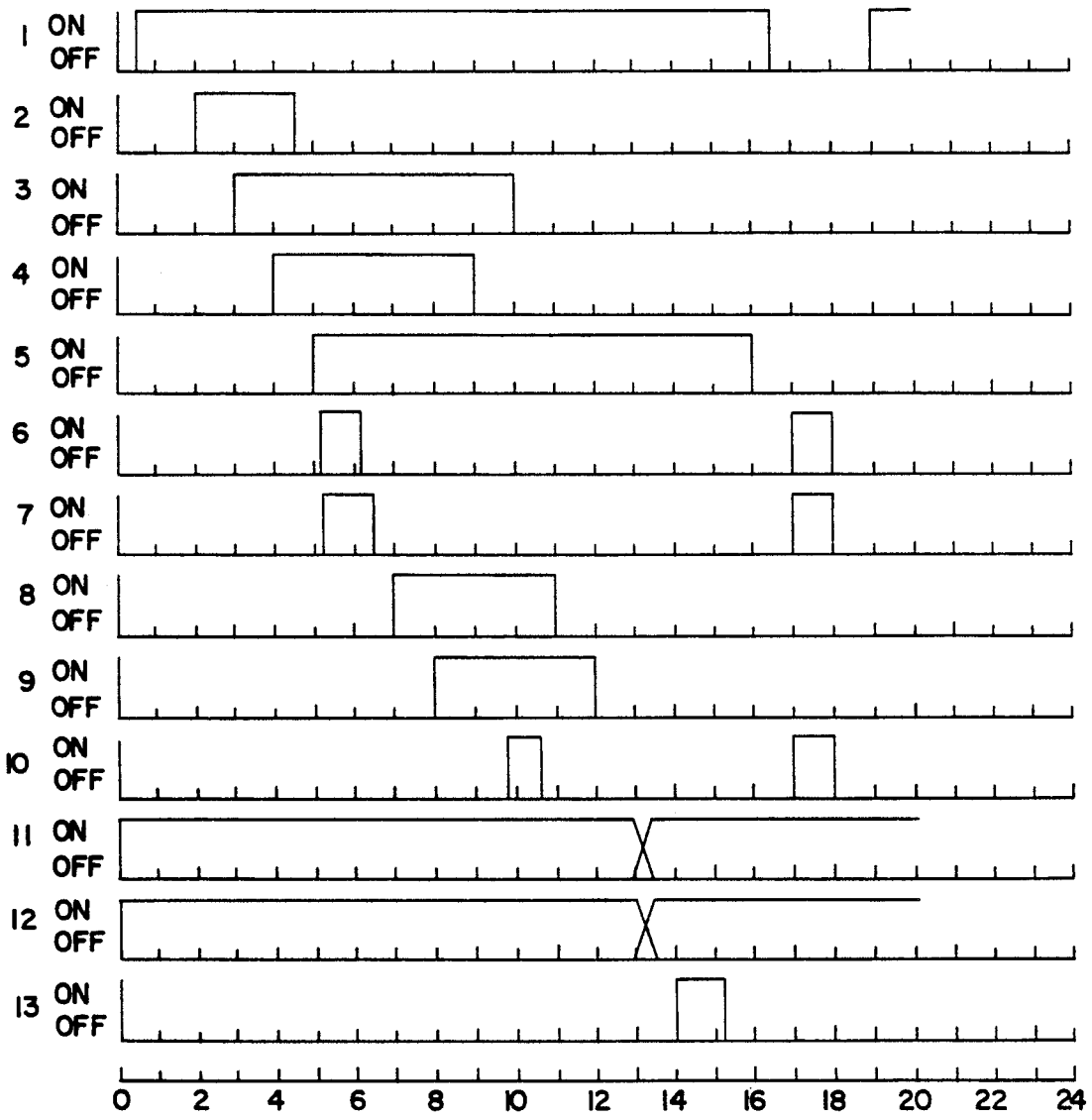
FIG. 1 is a computer timing diagram of the weaving steps of a method for forming three-dimensional fabrics according to the present invention.

Referring to FIG. 1 of the drawings which diagrammatically shows a timing diagram of a three-dimensional weaving process according to the present invention, a cycle of the weaving process is divided into several different motions. The key to the numeral designated motions shown in the timing diagram of FIG. 1 is shown in FIG. 2 and is also set forth below for a better understanding of the invention. It should be noted that applicants prefer that the weaving process be controlled by a suitably programmed personal computer, but other control mechanisms can be utilized and would be apparent to one skilled in the art. The timing numeral key (and timing sequence) is as follows:

| Number | Motion |
|---|---|
| 1 | Filling Lock and Selvage Lock |
| 2 | Filling Insertion |
| 3 | Selvage Needles |
| 4 | Selvage Hold Rod |
| 5 | Beat-Up |
| 6 | Filling Tension I |
| 7 | Filling Tension II |
| 8 | Loop Forming Rods |
| 9 | Selvage Latch Needles |
| 10 | Selvage Tension |
| 11 | Harness 1 and 2 |
| 12 | Harness 3 and 4 |
| 13 | Take-Up |

Figure 3:
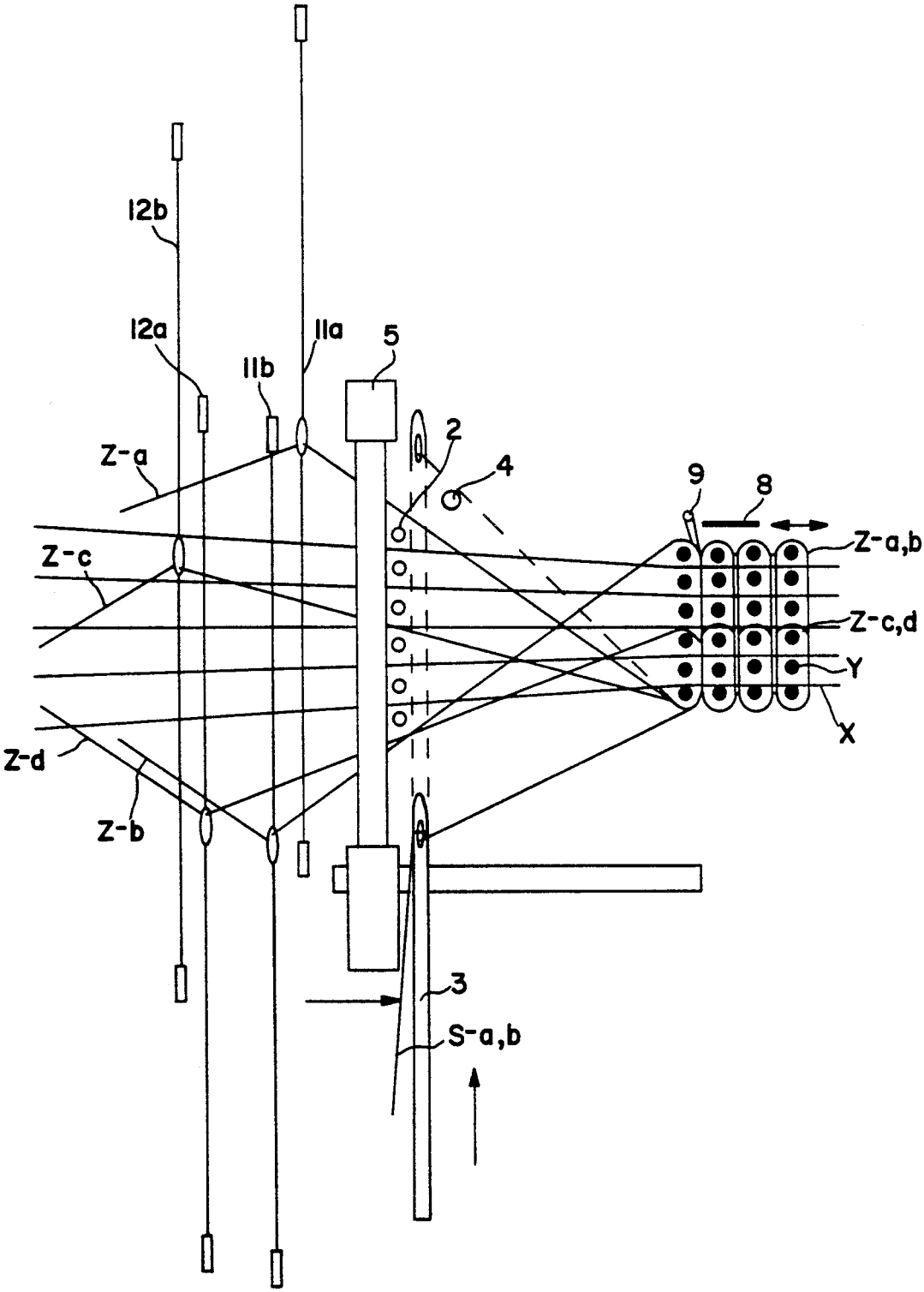
FIG. 3 shows a schematic side view of the process of the present invention at the beginning of the fabric formation cycle.
Figure 4:
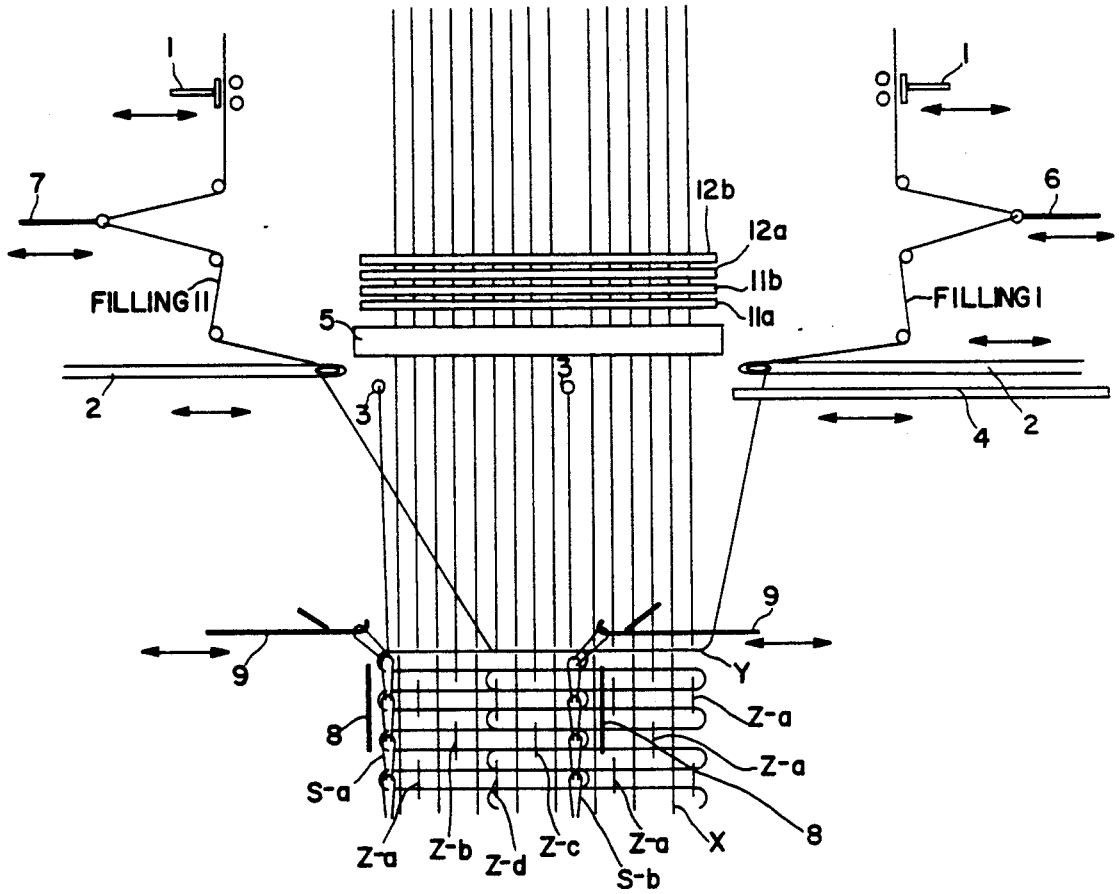
FIG. 4 shows a schematic top view corresponding to FIG. 3.
Figure 5:
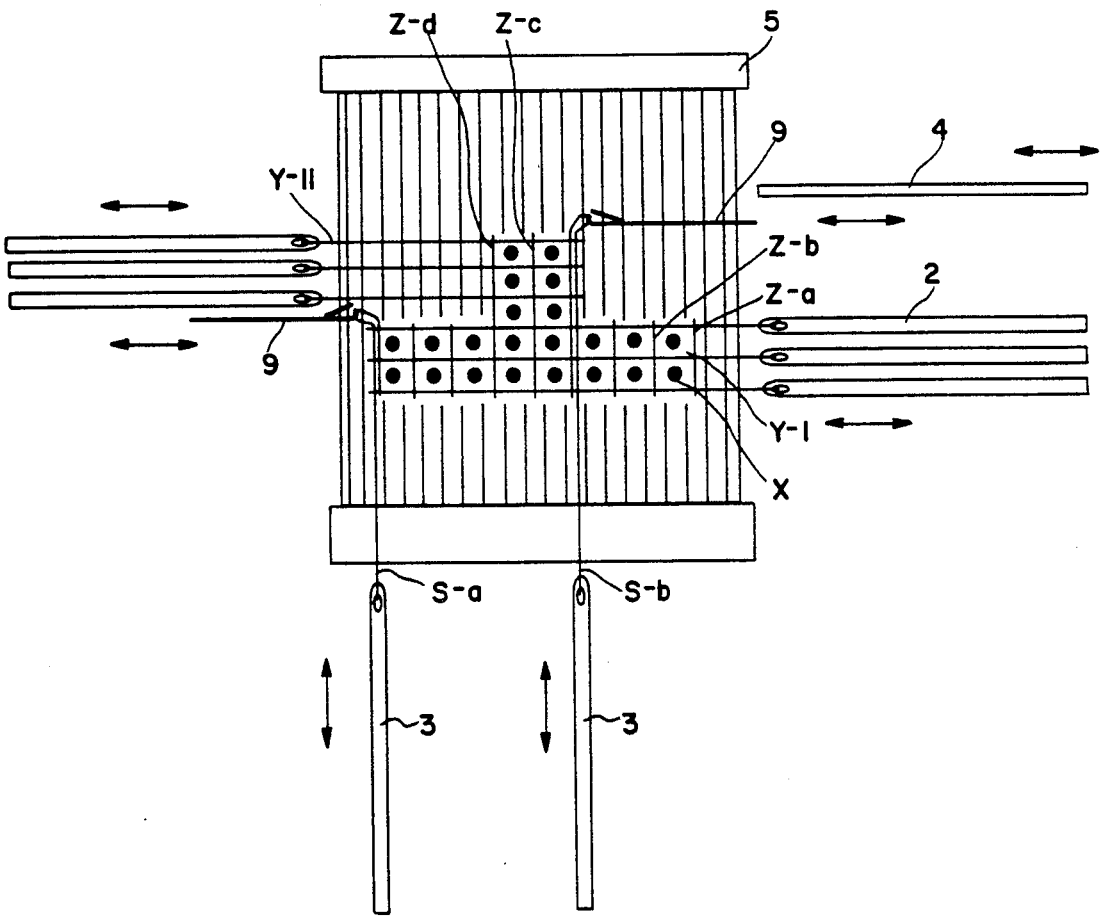
FIG. 5 shows a schematic front view corresponding to FIG. 3.
Figure 6:
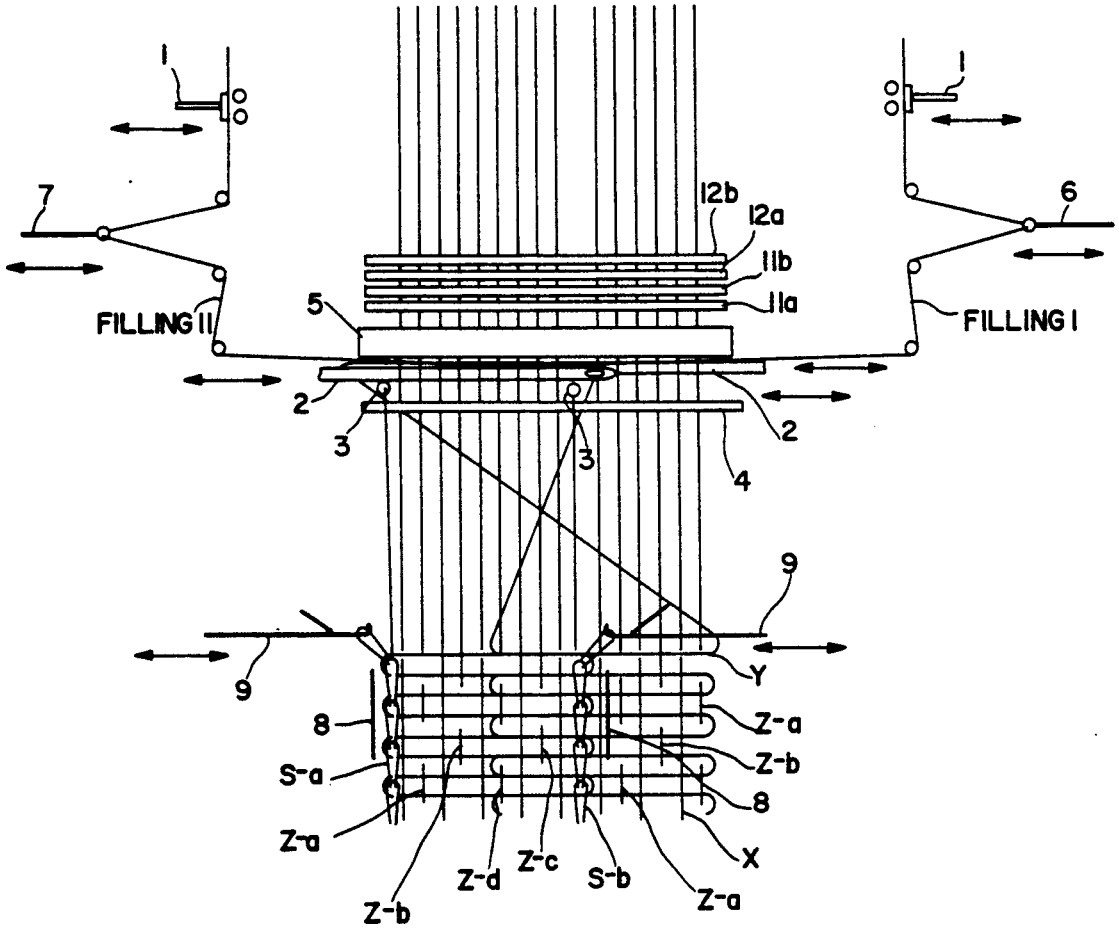
FIG. 6 shows a schematic top view of the process of the present invention with weft insertion simultaneously occurring from both sides of the fabric formation zone.

The beginning position of the fabric formation cycle is shown in FIGS. 3–5 of the drawings. The three-dimensional fabric to be formed can best be appreciated with reference to FIG. 5 wherein the inverted T cross-sectional shape can be clearly seen as defined by five layers of warp yarns X. Warp yarns X are most suitably drawn under tension from a creel (not shown) and between the heddles (not show) of harnesses 11*a*, 11*b* and 12*a*, 12*b* (see FIGS. 3 and 4) and then through reed 5 in layers of warp yarn which are in horizontal and vertical alignment. The cross section of three-dimensional fabric to be woven as defined by warp yarns X can be divided into two portions: 1) the horizontal bottom portion or flange; and 2) the vertical raised portion or web of the inverted T shape. The positioning of warp yarns X can clearly be seen in FIGS. 3–5.

Two groups of filling yarns, Y1 and Y2, are used for weft or filling insertion with one weft group (Y1) being inserted from one side for the flange and the other weft yarn group (Y2) being inserted from the other side for the web portion of the inverted T cross-shape (as best seen in FIG. 5). Two selvage yarns, Sa and Sb, are required to hold the fore end loops formed by the two different lengths of filling inserted by the two groups of filling yarns, Y1 and Y2, respectively. Preferably, four harnesses, 11*a*, 11*b*, 12*a*, 12*b*, are used to control two sets of vertical Z yarns, Za–Zd. One set of Z yarns, Za, Zb, is inserted for the flange portion of the inverted T shape fabric, and the other set of Z yarns, Zc, Zd, is inserted for the web portion of the inverted T cross-sectional shape fabric (see FIG. 5). Vertical yarns Z are most suitably drawn under tension from the same creel (not shown) as warp yarns X and through harnesses 11*a*, 11*b*, 12*a*, 12*b* and reed 5.

With reference again to the computer timing diagram of FIG. 1, a complete cycle of the weaving process will now be described in sequence. As the computer control program starts, the computer (not shown) sends a signal to actuate solenoids (not shown) controlling double-action air cylinders (not shown) which actuate filling lock devices 1 and selvage lock devices (not shown). The lock devices are actuated, and then both the filling yarns, Y1 and Y2, and selvage yarns, Sa and Sb, are locked so that the filling yarn and selvage yarn will be properly tensioned during the weaving process.

Next, two opposing sets of filling needles 2 insert filling yarns Y1 and Y2 between the warp yarn layers. One set of needles carrying the Y1 weft yarns goes through the flange portion of the warp yarn defined design and the other set of needles carrying the Y2 weft yarns goes through the web portion (see FIGS. 5 and 6). Subsequent to filling yarn insertion, two selvage needles 3 are raised up to the position shown in phantom line in FIG. 3, and selvage hold rod 4 is moved inwardly to the position shown in FIG. 6. (Selvage hold rod 4 serves to increase the space between selvage needles 3 and the selvage yarns, Sa and Sb, after beat-up reed 5 moves to the fell of the fabric to ensure adequate space for the insertion of latch needles 9 as described further below).

Figure 7:
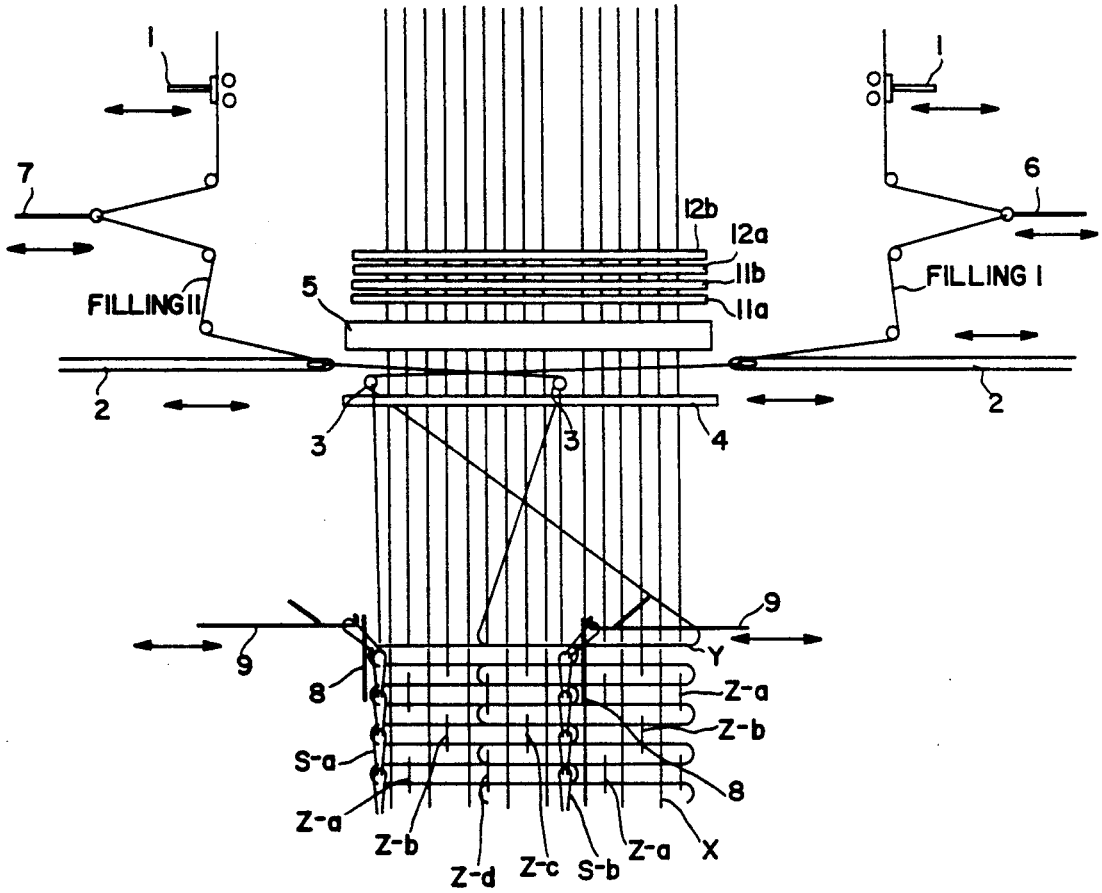
FIG. 7 shows a schematic top view of the weft yarn insertion needles withdrawing to their original positions on each side of the yarn formation zone and thereby forming fore end loops.
Figure 8:
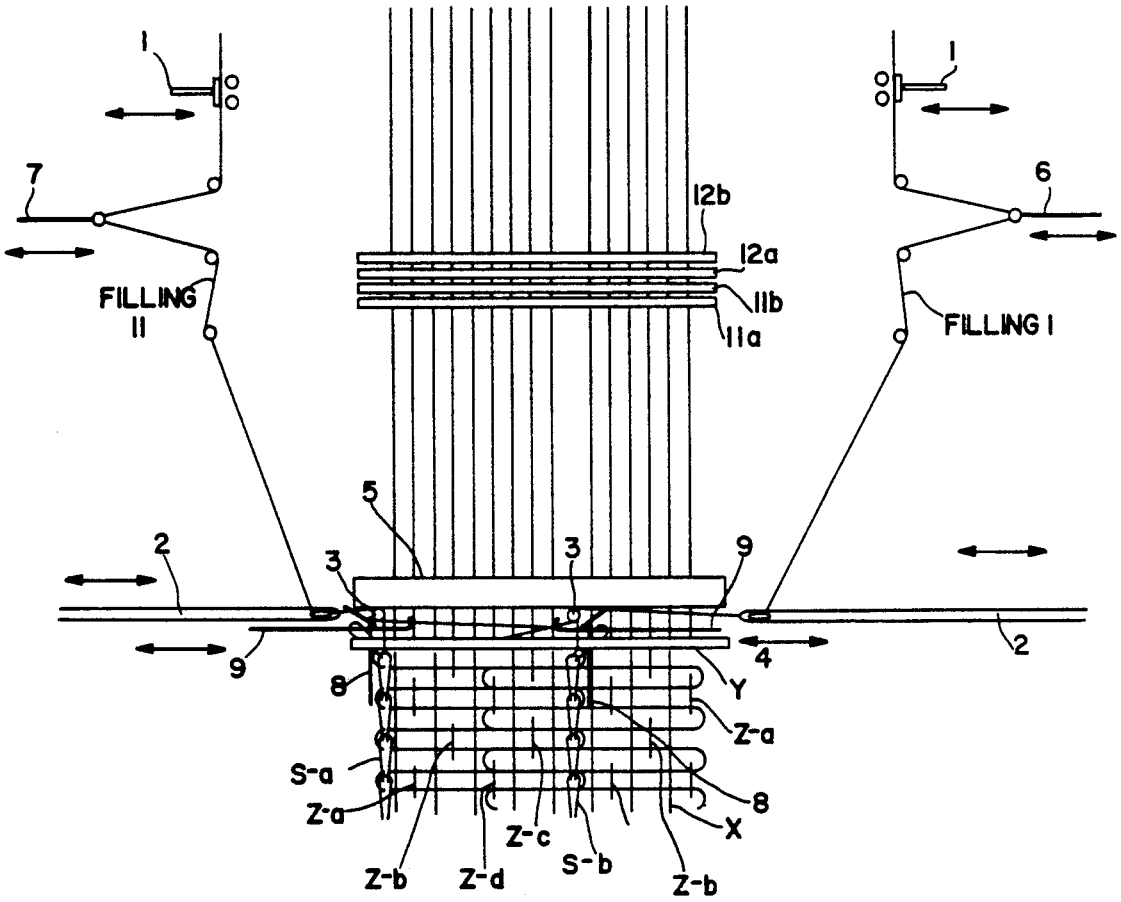
FIG. 8 is a schematic top view showing the reed moving forwardly to the fell of the three-dimensional fabric and the fabric beat-up motion.
Figure 9:
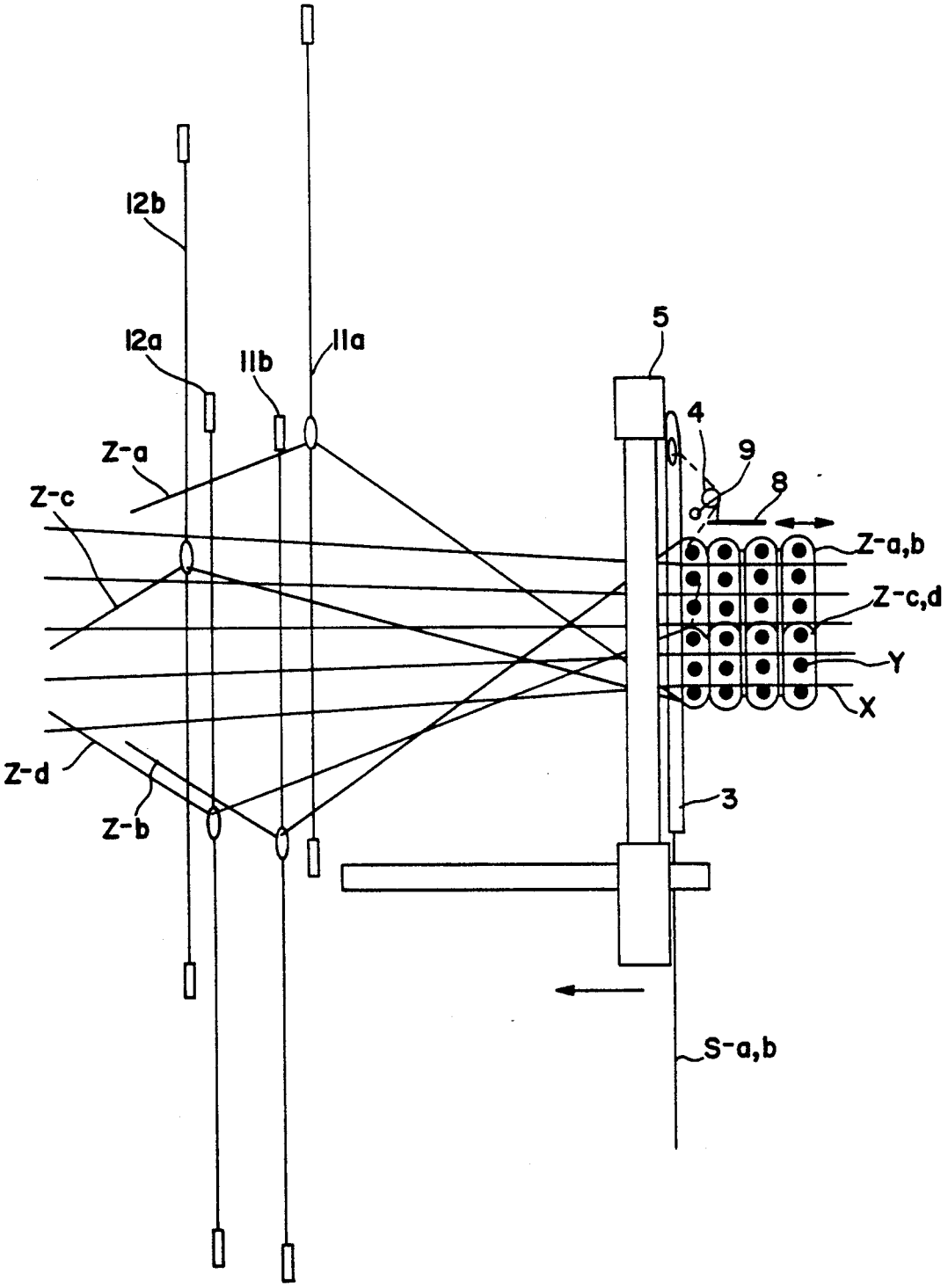
FIG. 9 is a schematic side view corresponding to FIG. 8 and prior to the reciprocation of the harnesses and to the fabric being taken-up and the reed moving back to its original position so as to complete the weaving cycle.
Figure 10:
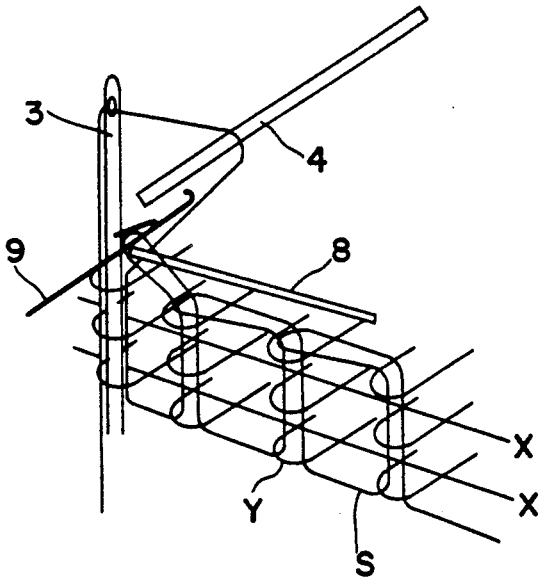
FIG. 10 is a schematic view of selvage yarn being inserted into the fore end loops formed by the weft yarns during the fabric formation process of the present invention.

As these motions are completed, filling needles 2 withdraw to their original positions on each side of the inverted T shape formed by the warp yarn layers so as to form fore end weft loops (see FIG. 7).

Reed 5 is now linearly moved forwardly (carrying the weft insertion system therewith) toward the fell of the fabric and filling tensioning devices 6 and 7 also begin to act so that the filling yarns (Y1 and Y2, respectively) are tensioned to keep the weft fore end loops tight. The timing of filling tensioning devices 6 and 7 (associated with filling yarns Y1 and Y2, respectively) and the duration of the tensioning period are dependent on such variables as the fabric width, yarn type, and other factors such as the air pressure of the two-way air cylinders (not shown) which, preferably, are used to pneumatically actuate all motions of the weaving process with the exception of the take-up motion which is preferably actuated by a suitable electric stepper motor and worm gear. Similar tensioning devices (not shown) are also used to apply tension to the selvage yarns, Sa, Sb. Preferably, spring force is used to apply and maintain a relatively low tension on the filling Y and selvage S yarns.

As beat-up reed 5 is linearly forced to the fell of the fabric (see FIGS. 8 and 9), the yarns are packed into a tight structure. Selvage loops are formed by rod 4 to ensure that latch needles 9 are inserted between selvage needles 3 and selvage yarns Sa, Sb (see FIGS. 9 and 10). Two rods 8 are brought to pass by the selvage loops that are on latch needles 9 and which can hold the loops formed on the needles during the previous cycle and further serve to help open the latches of needles 9 during the latch needle motion (see FIGS. 8–10).

After insertion of latch needles 9, rod 4 is pulled away and the selvage falls onto latch needles 9 between the hook and latch. Selvage insertion needles 3 are then lowered and the selvage tensioning devices are actuated to apply tension on the selvages so as to pull the selvages tight. Rods 8 move away from latch needles 9, and as latch needles 9 are withdrawing the loops formed by the last weaving cycle close the latch and slide off the needles so as to form new loops. Harnesses 11*a*, 11*b*, and 12*a*, 12*b* are then crossed so as to place the vertical or Z yarns into the fabric and thus lock-in and form a new series of weft picks with doubled filling yarns. Finally, the take-up device (preferably an electric stepper motor and worm gear) moves the formed structure a distance equal to the repeating cycle length of the fabric formation, and reed 5 is moved back to its original position with filling and selvage locking devices 1 being released. Most suitably, extra filling and selvage yarns are then withdrawn and stored in the associated tensioning devices, and locking devices 1 then lock the yarns in place again so that the aforementioned cycle may be again repeated in order to continuously produce the three-dimensional fabric in accordance with the method of the invention.

Applicants wish to emphasize that the principles for the formation of other shapes of fabric cross section are the same with necessary variations in the fabric formation process being within the ability of one skilled in the art of three-dimensional fabric weaving and within the contemplated scope of the instant invention.

Also, applicants wish to emphasize that although the fabric formation process described above would utilize only one pneumatic actuator on each side of the shape defined by the layers of warp yarn to simultaneously actuate the plurality of weft insertion needles 2 (see FIG. 5), other techniques are possible and within the scope of the invention including differential length weft insertion from only one side as well as alternative insertion of weft yarns from first one side and then the other side during the weaving process. Also, it is possible that two or more blocks of weft needles 2 may be independently pneumatically actuated for uniform or differential length weft insertion from each side of the shape formed by the warp layers in order to form certain complex cross-sectional fabric shapes for use as preforms and the like. By way of example and not limitation, an I cross-sectional shape could utilize simultaneous weft insertion from both sides with a single block of needles on one side serving to insert weft in the web of the I and two independent blocks of needles actuated by two independent pneumatic actuators on the other side serving to insert weft yarn into the top and bottom flange of the I shaped profile formed by the layers of warp yarn in the reed. Thus, weft insertion can be either simultaneous from both sides or from alternating sides, and the number of pneumatic actuators can vary on each side from one to a plurality of actuators each serving to motivate a block of weft insertion needles.

The commonality of the aforementioned variations is that the method of the present invention provides for differential length weft insertion from one or both sides of a three-dimensional fabric being formed in order to traverse the complex fabric profile defined by the horizontally and vertically aligned layers of warp yarn extending through the reed. Although applicants prefer the use of pneumatic actuators for all yarn formation motions (other than fabric take-up) for the manufacture of fabrics from materials such as carbon fibers, applicants contemplate that other apparatus could also be utilized by one skilled in the art and familiar with the novel fabric formation method of applicants' invention. The yarn lock and tensioning devices as well as the selvage hold rod and loop forming rods described herein are a matter of design choice and may also be modified as desired in the practice of the method of the invention.

Finally, applicants wish to note that many materials may be useful for weaving the variable cross-sectional shape three-dimensional fabric according to the present invention. These materials include, but are not limited to, organic fibrous material such as cotton, linen, wool, nylon, polyester, and polypropylene and the like and other inorganic fibrous materials such as glass fibre, carbon fibre, metallic fiber, asbestos and the like. These representative fibrous materials may be used in either filament or spun form.

It will be understood that various details of the invention may be changed without departing from the scope of the invention. Furthermore, the foregoing description is for the purpose of illustration only, and not for the claims.

What is claimed is:

1. A method for weaving a three-dimensional fabric having a variable predetermined cross-sectional shape comprising the steps of:

a. providing a plurality of layers of warp yarns which are in horizontal and vertical alignment and maintained under tension, said layers of warp yarns defining a variable predetermined cross-sectional shape;

b. selectively inserting a plurality of parallel weft yarns which are connected by a loop at the respective fore ends thereof into spaces between said layers of warp yarn, said parallel weft yarns being inserted a predetermined and differential horizontal distance from at least one side of said warp yarn cross-sectional shape in accordance with the shape of the fabric being formed;

c. threading selvage yarn through the loops at the fore ends of said weft yarns;

d. bringing a reed into contact with the fell of the fabric being formed;

e. inserting vertical yarns into spaces between vertical rows of said warp yarns in a direction substantially perpendicular to both said warp and said parallel weft yarns, said vertical yarns being selectively threaded through a plurality of harnesses so as to be separated into a predetermined plurality of vertically movable yarn systems by said harnesses in accordance with the shape of the fabric being formed, and said yarn systems being selectively vertically moved by said harnesses to insert said vertical yarns into said fabric; and f. forming a three-dimensional fabric by repeating the steps (a)–(e) after insertion of said vertical yarns.

2. A method according to claim 1 wherein an integral I shaped fabric is formed.

3. A method according to claim 1 wherein an integral T shaped fabric is formed.

4. A method according to claim 1 wherein said weft yarns are simultaneously inserted from both sides of said warp yarn cross-sectional shape.

5. A method according to claim 1 wherein said weft yarns are alternately inserted from opposing sides of said warp yarn cross-sectional shape.

6. A method according to claim 4 or 5 wherein said weft yarns from one side of said warp yarn cross-sectional shape are inserted different horizontal distances than said weft yarns from the other side of said warp yarn cross-sectional shape.

7. A method according to claim 4 or 5 wherein the weft yarns from each side of said warp yarn cross-sectional shape are inserted non-uniform horizontal distances.

8. A method according to claim 1 wherein said selvage yarn is threaded through the fore end loops of said weft yarns by latch needles.

9. A three-dimensional fabric made in accordance with the method of claim 1.

10. A method for weaving a three-dimensional fabric having a variable predetermined cross-sectional shape comprising the steps of:

a. providing a plurality of layers of warp yarns which are in horizontal and vertical alignment and maintained under tension, said layers of warp yarns defining a variable predetermined cross-sectional shape;

b. selectively inserting a plurality of weft yarns which are connected by a loop at the respective fore ends thereof into spaces between said layers of warp yarn, said weft yarns being simultaneously inserted a predetermined and differential horizontal distance from both sides of said warp yarn cross-sectional shape in accordance with the shape of the fabric being formed;

c. threading selvage yarn through the loops at the fore ends of said weft yarns;

d. bringing a reed into contact with the fell of the fabric being formed;

e. inserting vertical yarns into spaces between vertical rows of said warp yarns in a direction substantially perpendicular to both said warp and weft yarns, said vertical yarns being selectively threaded through a plurality of harnesses so as to be separated into a predetermined plurality of vertically movable yarn systems by said harnesses in accordance with the shape of the fabric being formed, and said yarn systems being selectively vertically moved by said harnesses to insert said vertical yarns into said fabric; and f. repeating the steps (a)–(e) after insertion of said vertical yarns.

11. A method for weaving a three-dimensional fabric having a variable predetermined cross-sectional shape comprising the steps of:

a. providing a plurality of layers of warp yarns which are in horizontal and vertical alignment and maintained under tension, said layers of warp yarns defining a variable predetermined cross-sectional shape;

b. selectively inserting a plurality of weft yarns which are connected by a loop at the respective fore ends thereof into spaces between said layers of warp yarn, said weft yarns being simultaneously inserted a predetermined and differential horizontal distance from both sides of said warp yarn cross-sectional shape in accordance with the shape of the fabric being formed, said weft yarns from one side of said warp yarn cross-sectional shape being inserted different horizontal distances than weft yarns from the other side;

c. threading selvage yarn through the loops at the fore ends of said weft yarns;

d. bringing a reed into contact with the feel of the fabric being formed;

e. inserting vertical yarns into spaces between vertical rows of said warp yarns in a direction substantially perpendicular to both said warp and weft yarns, said vertical yarns being selectively threaded through a plurality of harnesses so as to be separated into a predetermined plurality of vertically movable yarn systems by said harnesses in accordance with the shape of the fabric being formed, and said yarn systems being selectively vertically moved by said harnesses to insert said vertical yarns into said fabric;

f. repeating the steps (a)–(e) after insertion of said vertical yarns.

12. A method for wearing a three-dimensional fabric having a variable predetermined cross-sectional shape comprising the steps of:

a. providing a plurality of layers of warp yarns which are in horizontal and vertical alignment and maintained under tension, said layers of warp yarns defining a variable predetermined cross-sectional shape;

b. selectively inserting a plurality of weft yarns which are connected by a loop at the respective fore ends thereof into spaces between said layers of warp yarn, said weft yarns being alternatively inserted a predetermined and differential horizontal distance from opposing sides of said warp yarn cross-sectional shape in accordance with the shape of the fabric being formed, said weft yarns from one side of said warp yarn cross-sectional shape being inserted different horizontal distances than weft yarns from the other side;

c. threading selvage yarn through the loops at the fore ends of said weft yarns;

d. bringing a reed into contact with the feel of the fabric being formed;

e. inserting vertical yarns into spaces between vertical rows of said warp yarns in a direction substantially perpendicular to both said warp and weft yarns, said vertical yarns being selectively threaded through a plurality of harnesses so as to be separated into a predetermined plurality of vertically movable yarn systems by said harnesses in accordance with the shape of the fabric being formed, and said yarns systems being selectively vertically moved by said harnesses to insert said vertical yarns into said fabric; and f. repeating the steps (a)–(e) after insertion of said vertical yarns.

13. A method for weaving a three-dimensional fabric having a variable predetermined cross-sectional shape comprising the steps of:

a. providing a plurality of layers of warp yarns which are in horizontal and vertical alignment and maintained under tension, said layers of warp yarns defining a variable predetermined cross-sectional shape;

b. selectively inserting a plurality of weft yarns which are connected by a loop at the respective fore ends thereof into spaces between said layers of warp yarn, said weft yarns being simultaneously inserted a predetermined and differential horizontal distance from both sides of said warp yarn cross-sectional shape in accordance with the shape of the fabric being formed, said weft yarns from each side of said warp yarn cross-sectional shape being inserted non-uniform horizontal distances;

c. threading selvage yarn through the loops at the fore ends of said weft yarns;

d. bringing a reed into contact with the fell of the fabric being formed;

e. inserting vertical yarns into spaces between vertical rows of said warp yarns in a direction substantially perpendicular to both said warp and weft yarns, said vertical yarns being selectively threaded through a plurality of harnesses so as to be separated into a predetermined plurality of vertically movable yarn systems by said harnesses in accordance with the shape of the fabric being formed, and said yarn systems being selectively vertically moved by said harnesses to insert said vertical yarns into said fabric; and f. repeating the steps (a)–(e) after insertion of said vertical yarns.

14. A method for weaving a three-dimensional fabric having a variable predetermined cross-sectional shape comprising the steps of:

a. providing a plurality of layers of warp yarns which are in horizontal and vertical alignment and maintained under tension, said layers of warp yarns defining a variable predetermined cross-sectional shape;

b. selectively inserting a plurality of weft yarns which are connected by a loop at the respective fore ends thereof into spaces between said layers of warp yarn, said weft yarns being alternately inserted a predetermined and differential horizontal distance from opposing sides of said warp yarn cross-sectional shape in accordance with the shape of the fabric being formed, said weft yarns from each side of said warp yarn cross-sectional shape being inserted non-uniform horizontal distances;

c. threading selvage yarn through the loops at the fore ends of said weft yarns;

d. bringing a reed into contact with the fell of the fabric being formed;

e. inserting vertical yarns into spaces between vertical rows of said warp yarns in a direction substantially perpendicular to both said warp and weft yarns, said vertical yarns being selectively threaded through a plurality of harnesses so as to be separated into a predetermined plurality of vertically movable yarn systems by said harnesses in accordance with the shape of the fabric being formed, and said yarn systems being selectively vertically moved by said harnesses to insert said vertical yarns into said fabric; and f. repeating the steps (a)–(e) after insertion of said vertical yarns.

* * * * *